US008322538B2

(12) United States Patent
Janssen

(10) Patent No.: US 8,322,538 B2
(45) Date of Patent: Dec. 4, 2012

(54) METHOD AND APPARATUS FOR SEPARATING FINES FROM ROCK

(76) Inventor: Bill M. Janssen, House Springs, MO (US)

( * ) Notice: Subject to any disclaimer, the term of this patent is extended or adjusted under 35 U.S.C. 154(b) by 184 days.

(21) Appl. No.: 12/543,907

(22) Filed: Aug. 19, 2009

(65) Prior Publication Data

US 2011/0042278 A1 Feb. 24, 2011

(51) Int. Cl.
*B07C 5/04* (2006.01)

(52) U.S. Cl. ..... 209/691; 209/45; 209/615; 209/692; 209/707

(58) Field of Classification Search ..... 209/45, 209/58, 64, 65, 615, 691–693, 707
See application file for complete search history.

(56) References Cited

U.S. PATENT DOCUMENTS 1,705,456 A * 3/1929 Katayama ..... 209/692
2,358,506 A 9/1944 Guthrie et al.
2,772,776 A * 12/1956 Myron ..... 209/45
2,788,124 A 4/1957 Miller
3,040,885 A * 6/1962 Bruneau ..... 209/14
3,666,091 A 5/1972 Ludlum
3,939,881 A 2/1976 Scott
4,059,189 A 11/1977 John
4,078,663 A 3/1978 Barker et al.
4,118,309 A 10/1978 Myers et al.
4,141,450 A * 2/1979 Clin et al. ..... 209/3.1
4,146,483 A 3/1979 Lee
4,174,030 A * 11/1979 Philibert ..... 198/494
4,194,922 A 3/1980 Gransell et al.
4,295,569 A 10/1981 Niederer
4,385,702 A 5/1983 Lenker et al.
4,407,403 A * 10/1983 Wadensten ..... 198/494
4,521,302 A 6/1985 Stone
4,532,030 A * 7/1985 Avedian et al. ..... 209/45
(Continued)

FOREIGN PATENT DOCUMENTS

DE 4117029 A1 * 11/1992

*Primary Examiner* — Joseph C Rodriguez
(74) *Attorney, Agent, or Firm* — Brian B. Diekhoff; Polsinelli Shughart PC

(57) ABSTRACT

The methods and apparatus separate fines from crushed rock and stone. A motorized conveyor belt system is activated that includes a conveyor belt moving in an upward direction. A spray system is activated to spray a fluid on an underneath surface of the conveyor belt. The mixture of rock and fines are directed to the conveyor belt. The rock tumbles or rolls down the conveyor belt and is collected at a first end of the conveyor belt. The fines stick or adhere to the conveyor belt, and the fines are scraped off of the conveyor belt at or near the second end of the conveyor belt.

The apparatus includes a conveyor belt system, including a moving belt, a motor to move the belt, the belt including a first end and a second end, wherein the second end is elevated relative to the first end. The apparatus includes a spray system, including a source of fluid, a sprayer in fluidic communication with the source of the fluid, and the sprayer positioned to spray a surface of the belt with the fluid. The apparatus includes a material feed system, including a hopper to discharge a material of fines and rock onto the belt proximate the second end of the belt, and the belt moving from the first end to the second end in an upward direction. The apparatus includes a fines discharge to receive fines from the belt and a rock discharge at the first end of the belt.

25 Claims, 7 Drawing Sheets

U.S. PATENT DOCUMENTS 4,610,897 A 9/1986 Lipscomb et al.
4,768,645 A * 9/1988 Farris ..... 198/499
4,865,720 A 9/1989 Gilmore
4,969,928 A 11/1990 Wen et al.
4,986,424 A 1/1991 Berrebi et al.
5,080,235 A 1/1992 Nichols et al.
5,087,379 A 2/1992 Morton et al.
5,303,826 A * 4/1994 Buzga ..... 209/46
5,409,626 A 4/1995 Muth
5,536,429 A 7/1996 Bennett et al.
5,637,349 A 6/1997 Cummins et al.
5,660,282 A * 8/1997 Djerf et al. ..... 209/11
5,720,438 A 2/1998 Devine et al.
5,772,130 A 6/1998 Toschi
5,777,890 A 7/1998 Halley et al.
5,803,955 A 9/1998 Raring
5,957,297 A * 9/1999 Eramaja ..... 209/20
6,530,203 B2 3/2003 Suzuki et al.
6,994,221 B2 2/2006 Tse
7,347,331 B2 * 3/2008 Hendrickson et al. ..... 209/693
7,726,493 B2 * 6/2010 Van Der Weijden et al. . 209/218

* cited by examiner

METHOD AND APPARATUS FOR SEPARATING FINES FROM ROCK

FIELD OF INVENTION

The present invention relates to methods and apparatus for separating fines and smaller particles from a rock mixture.

BACKGROUND OF INVENTION

Crushed rock is typically used for many construction applications. Crushed rock is often used as a lower layer for the construction of roads, pavement, and highways. The crushed rock may be spread over the ground, and asphalt or concrete may be applied over the top of the layer of crushed rock.

The crushed rock is often mined from rock quarries. Large rock is crushed and broken into smaller rock particles. During the processing of the larger rock into the crushed rock, dust, fines, and small particulate matter is inherently produced. Many road construction projects require that the crushed rock only contain a minimum level of this "fine" material. Crushed rock that contains too much of this fine material may be rejected as being out of specification. Typically, many road construction projects require that the crushed rock have a content of no more than approximately 5% fine material. The excess fine content in the crushed rock results in an increased amount of oil needed in the asphalt. If the crushed rock contains an excess amount of the fines, then the entire shipment of the crushed rock may be rejected.

Previous attempts to remove fines or lower the fine content of crushed rock have involved expensive and difficult to maintain equipment. Moreover, many of the prior art attempts and designs to remove the fines from the crushed rock results in excessive waste by-products. For example, one such prior art device to remove fines from the crushed rock includes an air separation device. The air separation device uses large fans and turbines to blow the fines from the crushed rock. The fines are collected in receptacles that allow the blown air to pass through. However, the blowing of the fines degradates the fans and turbines of such air separation devices. Constant maintenance and replacements of such fans and turbines is required.

Other attempts to remove the fines from the crushed rock involve the use of log washers. The crushed rock and fines are washed in the log washers with water in order to separate the fines from the crushed rock. The fines typically float, and the fine and are washed from the heavier crushed rock particles. However, the use of the log washers results in waste pools of water containing the fines. Also, the now wet fines removed by the log washer may require additional drying steps or processes before the fines can be used as a material for certain applications.

Also, conventional wet or dry vibrating screens with very fine openings are employed to remove the fines from the crushed rock. Unfortunately, the screens used in the dry screening process have very fine openings, which tend to plug with rock material. Force-drying the fines and crushed rock, prior to the dry screening, alleviates some of problems with the plugging of the openings of the screen, but this step requires additional equipment and labor. Wet screening results in some of the similar discharge water problems as encountered with log washing. As such, the wet and dry screening processes are problematic for various reasons.

SUMMARY OF THE INVENTION

The apparatus and methods described herein provide for fine and dust control and for fine and dust removal from rocks, stones, or other debris obtained from a quarry, wherein such rock, stone, other debris containing fines, dust, or particulate matter would be undesirable in a particular application. The methods and apparatus provide an efficient and effective manner to remove fines and dust from the rock and stones. The methods and apparatus provide less environmental problems as compared to prior art devices and processes.

The methods and apparatus remove fines from the crushed rock and stone by combining an elevated conveyor belt system, a spray system, a material feed hopper, a scraper, and a dust removal discharge chute. A motor operates a conveyor belt, which is angled at a substantial degree relative to the ground, so that the crushed rock material is not conveyed up and over the top of the conveyor belt. The conveyor belt moves in one direction (toward the top of the elevated conveyor) with the fines, while the crushed rock material moves down the conveyor belt in the direction opposite of the travel of the conveyor belt.

In operation, the crushed rock material is fed onto the conveyor belt from the material feed hopper or other material loading means. The conveyor belt and the coarse particles of the crushed rock material move in opposite directions, thereby creating a counter-flow between the conveyor belt and the coarse particles of the crushed rock material. The fines of the crushed rock material move with and are retained on the conveyor belt. The fines remain on the conveyor belt until removed by scraping or other removal means and methods.

The conveyor belt is sprayed with water or other wetting agents. The conveyor belt may be vibrated by cage idlers or other devices. The vibration aids in rolling and bouncing the coarse particles of the crushed rock material down the conveyor belt and providing many opportunities for the dust and fines, on and among the coarse particles, to contact the conveyor belt. The vibration of the conveyor belt tends to discharge the coarse particles from the conveyor belt surface leaving more "open space" on the conveyor belt to collect the fines. More or less vibration influences the gradation of the finished product, and, in some cases, less vibration may be desirable to achieve a certain specification of crushed rock particles. The dust and fines from the crushed rock material are attracted by the water or other wetting agents on the conveyor belt and collect on the conveyor belt. The fines mixed in with the crushed rock, or that are sticking to the crushed rock, are generally separated and collected on the conveyor belt.

A scraper located toward the top and at the underside of the conveyor belt scrapes away the collected fines and dust, which may be directed to the discharge chute and then collected for disposal or sale at the end of the discharge chute. The material being conveyed, moving in the opposite direction of the conveyor belt, moves down the conveyor belt by gravity and into a collection apparatus.

As described herein, the methods and apparatus remove fines from larger rock. As used herein, the term "fines" includes dust, small particles, and other particulate matter mixed in and/or adhered to larger coarse rock particles, crushed rock and stone. The fines are generally the same material as the larger rock, namely crushed limestone, although the methods and apparatus may be used with other rock and stone materials. The fines are typically the material that passes through a 200 mesh on a standard sieve. The term "200 mesh," is well known to one of ordinary skill in the art and generally refers to a mesh sheet having approximately 200 openings per square inch. The fines that pass through the 200 mesh may be referred to as a −200 material. Typically, crushed rock particles with an excess amount of −200 content may be out of specification for a certain project. Many construction and road building applications require a −200 content of less than 5% by weight, however the exact level will vary depending on the individual specification. As used herein, the term "coarse particles" are the component of the crushed rock mixture separated from the fines. The coarse particles will generally not pass through the 200 mesh.

The methods and apparatus described herein work most efficiently when the mixture of material comprising the crushed rock and fines is in a relatively dry state. Water should not be added to the crushed rock material prior to processing with the methods and apparatus herein described. A wet crushed rock material will reduce the efficiency of the methods and apparatus.

DETAILED DESCRIPTION OF PREFERRED EMBODIMENTS

Figure 1:
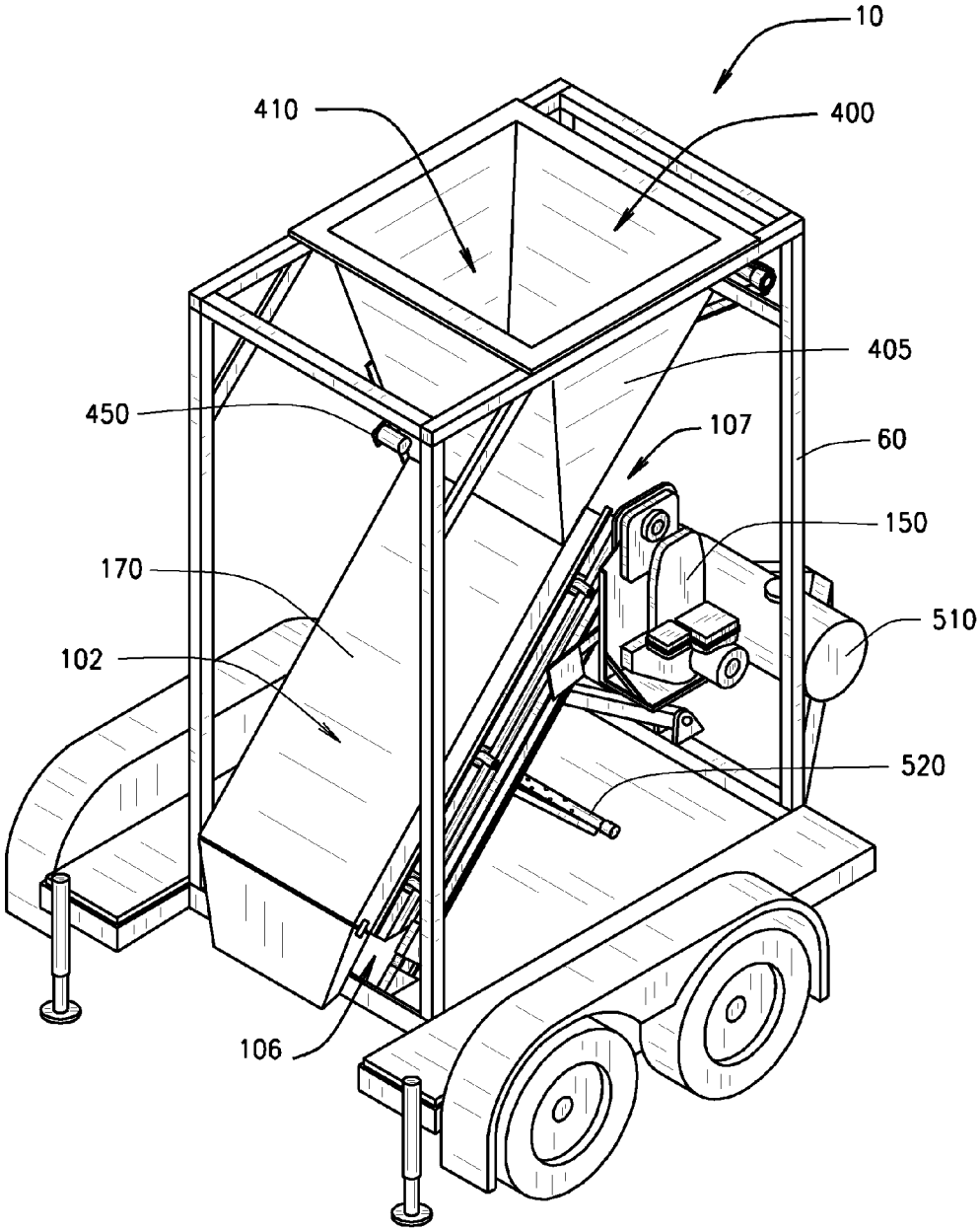
FIG. 1 is a front, perspective view of the apparatus for removing the fines from the mixture of rock and fines.

The methods and apparatus will now be described with respect to the Figures. An apparatus 10 for removing fines from crushed rock material is shown in FIG. 1. The apparatus 10 receives a supply of a crushed rock material 50, which includes a mixture of fines 54, coarse particles 58, and other matter. The apparatus 10 separates at least some of the fines 54 from the coarse particles 58. The apparatus 10 lowers the content of fines 54 in the crushed rock material 50.

The crushed rock material 50 has been mined or collected from a rock quarry or other source. Typically, most of the large bulky rocks in the crushed rock material 50, over for example, several inches in size, have already been reduced or crushed.

The apparatus 10 includes a frame 60 that supports a conveyor belt system 100. The frame 60 is generally constructed of rigid material, such as steel, with sufficient strength to supports the components of the apparatus 10. The frame 60 may rest on a trailer, the ground, or be integrally connected to further quarry and rock processing equipment.

The conveyor belt system 100 includes a conveyor belt 102 that is moved by a motor 150. The conveyor belt 102 is positioned in a slanting or sloping manner in which a first end 106 of the conveyor belt 102 is lower than a higher, second end 107 of the conveyor belt 102. The conveyor belt 102 further includes a top surface 104 and a bottom surface 105. The material 50 is fed or dropped onto the top surface 104 adjacent or near the second end 107 of the conveyor belt 102. By dropping the material 50 onto the top surface 104 adjacent or near the second end 107, the material 50 is allowed to contact much of or a majority of the conveyor belt 102. The material 50 may be dropped onto the top surface 104 anywhere in the upper third region of the length of the conveyor belt 102 adjacent the second end 107. By dropping the material in this region of the conveyor bolt 103, unwanted carryover of the coarse particles 58 with the fines 54 into a discharge chute 250 is reduced.

The motor 150 is in operational engagement with the conveyor belt 102. The motor 150 actuates a head pulley 153 that causes the conveyor belt 102 to move in an upward or elevating direction, i.e., the conveyor belt 102 moves from the lower, first end 106 toward the higher, second end 107. A tail pulley 156 provides rotating support to the moving conveyor belt 102 at the first end 106. The conveyor belt 102 provides an endless belt moving between the head pulley 153 and the tail pulley 156.

Figure 2:
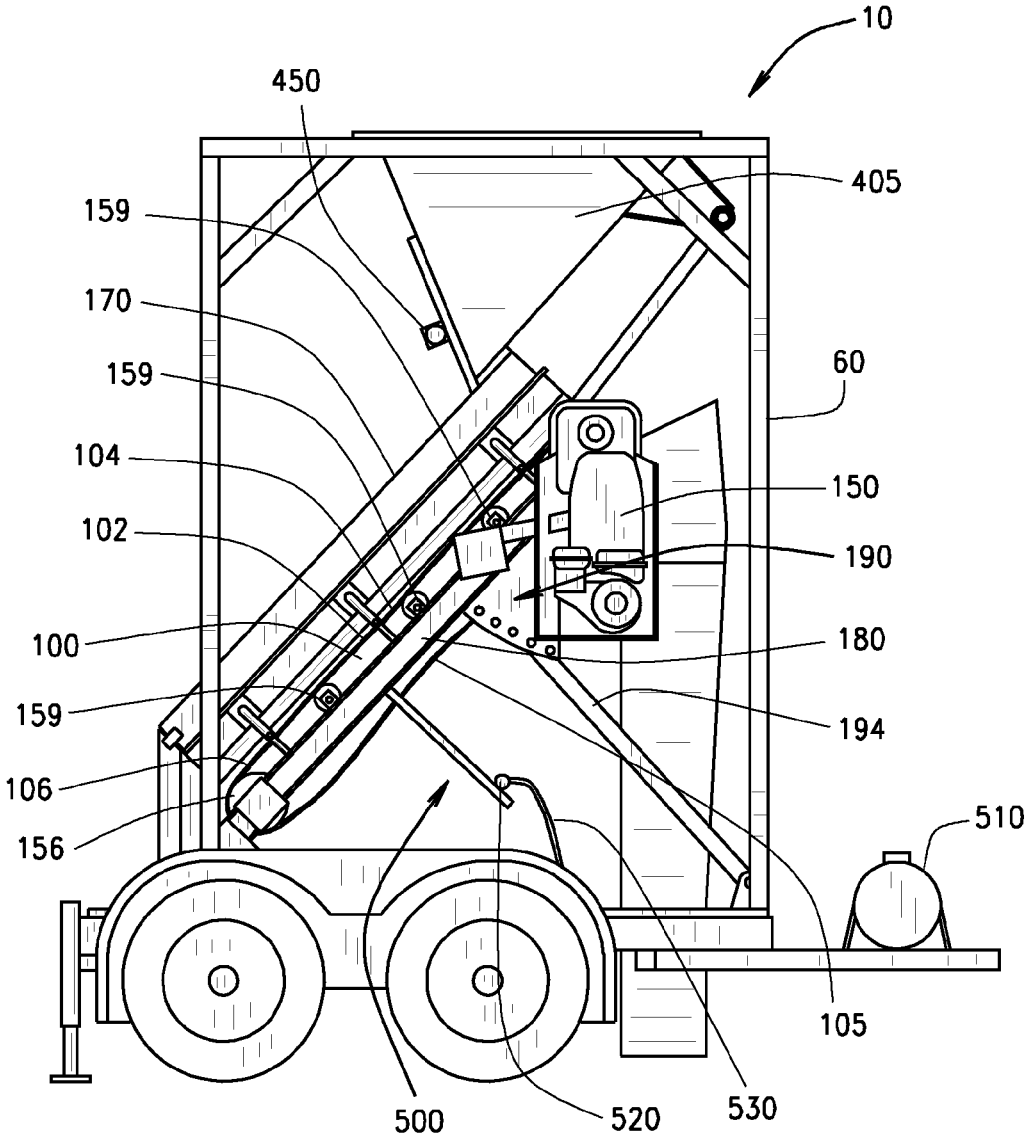
FIG. 2 is a right side view of the apparatus for removing the fines from the mixture of rock and fines.
Figure 3:
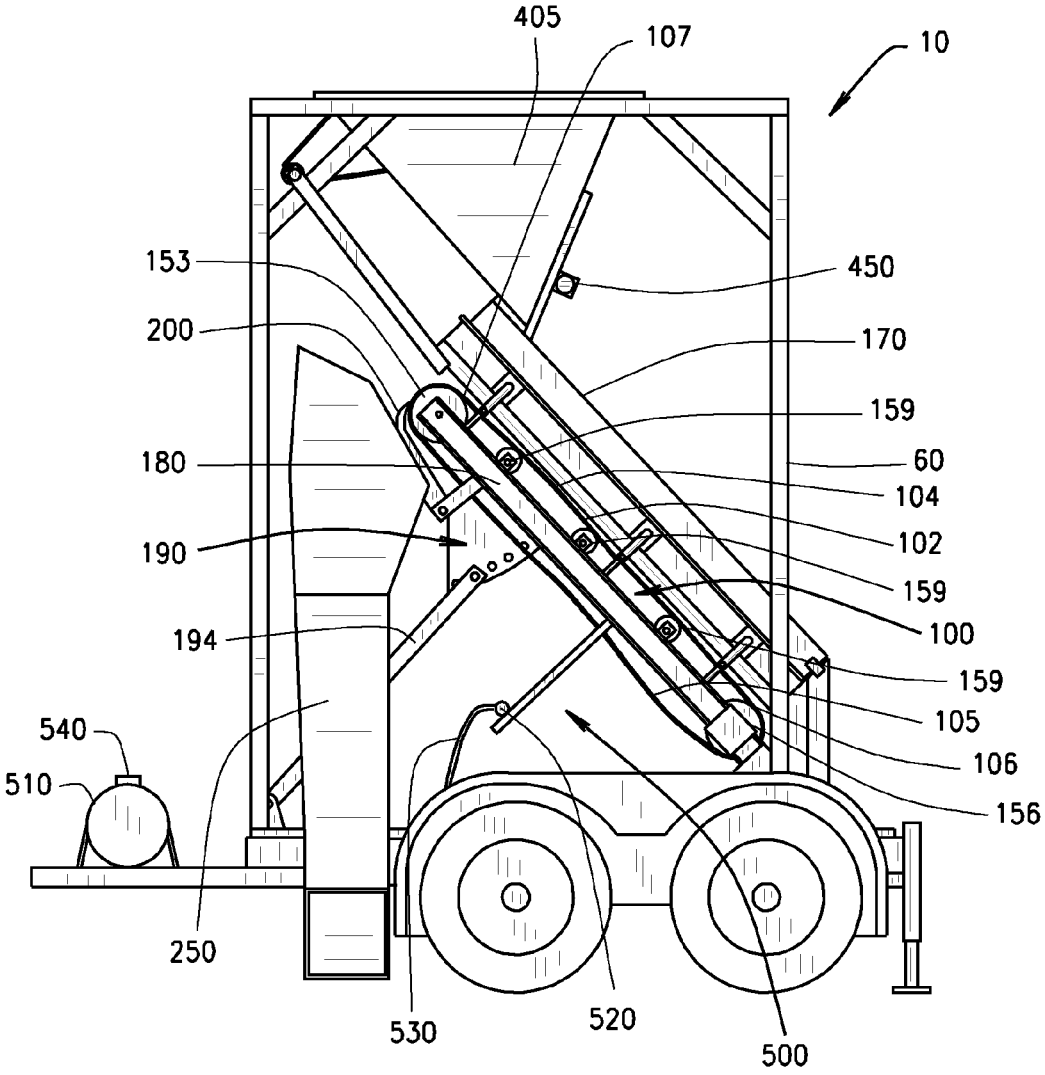
FIG. 3 is a left side view of the apparatus for removing the fines from the mixture of rock and fines.
Figure 4:
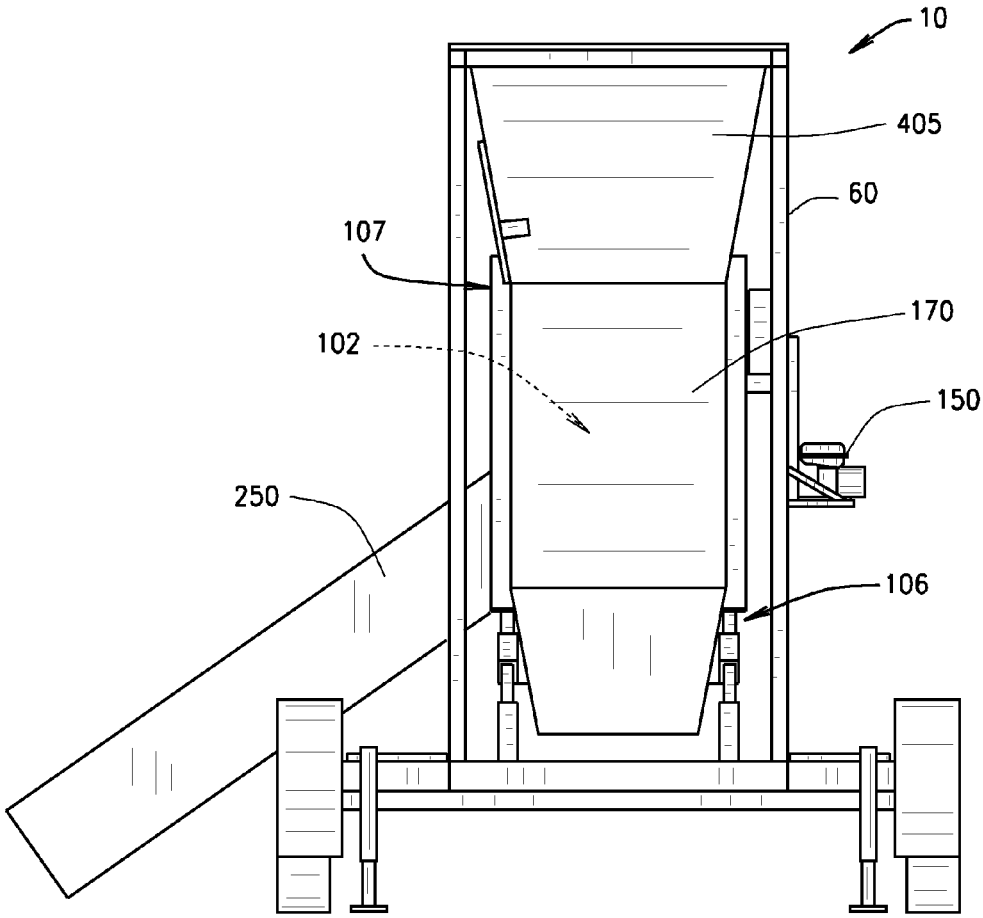
FIG. 4 is a front view of the apparatus for removing the fines from the mixture of rock and fines.

With reference to FIGS. 2 and 3, a plurality of optional cage idlers 159 may be positioned along the conveyor belt 102. In the embodiment shown in the Figures, the cage idlers 159 are positioned between the head pulley 153 and the tail pulley 156. The cage idlers 159 provide a vibrating force to the conveyor belt 102. The vibration assists in causing the coarse particles 58 to discharge from the conveyor belt 102, i.e., the coarse particles 58 bounce, tumble, and/or roll down the conveyor belt 102 toward the first end 106.

The conveyor belt 102 is mounted onto a conveyor frame 180. The conveyor frame 180 supports the head pulley 153, the tail pulley 156, and the cage idlers 159 in an operational engagement with the conveyor belt 102. The conveyor belt system 100 further includes a pivoting belt adjusting system 190 and a belt angle adjuster 194 to vary the angle of the conveyor belt 102. The conveyor belt system 100 further includes a tail-pulley belt tensioner.

Most or all of the length of the conveyor belt 102 is provided with a cover 170 to help contain the crushed rock material 50 on or about the conveyor belt 102. The coarse particles 58 of the crushed rock material 50 may roll down and bounce with such speed and force that the cover 170 is necessary to maintain and collect the coarse particles 58 discharging at the first end 106 instead of the coarse particles 58 bouncing away from the apparatus 10.

A material feed hopper system 400 feeds or directs the crushed rock material 50 to the conveyor belt 102. In the embodiment shown, the material feed hopper system 400 includes a hopper 405 with an interior holding portion 410. The interior holding portion 410 may be supplied with the crushed rock material 50 via a conveyor belt, a bucket lifter, chute, vibrating feeder, belt feeder, etc. or other means to provide the hopper 405 with an even or controlled flow of the crushed rock material 50. The hopper 405 may be replaced with any device that provides an adjustable, controlled flow of the crushed rock material 50 to the conveyor belt 102. An even, regulated feed of the crushed rock material 50 is important in obtaining uniform and predictable results from the apparatus 10.

Figure 5:
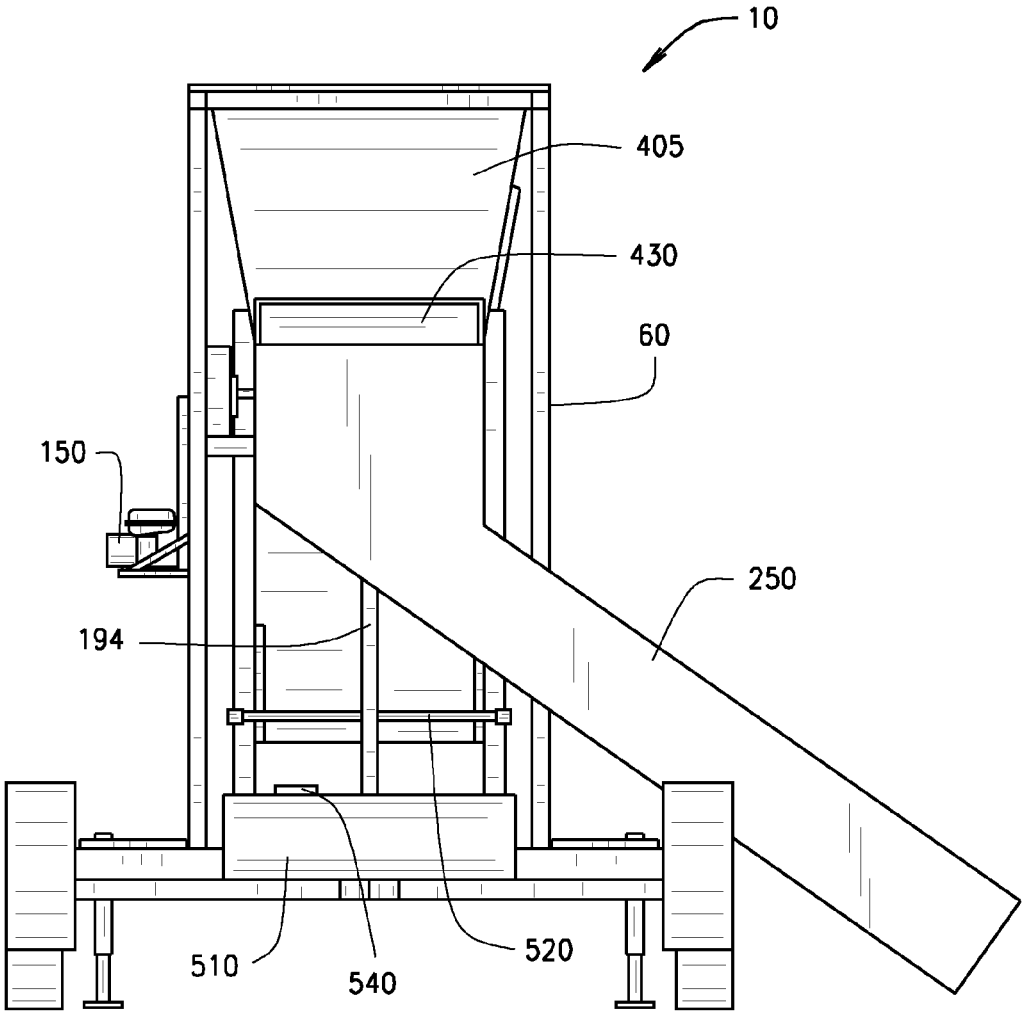
FIG. 5 is a rear view of the apparatus for removing the fines from the mixture of rock and fines.
Figure 6:
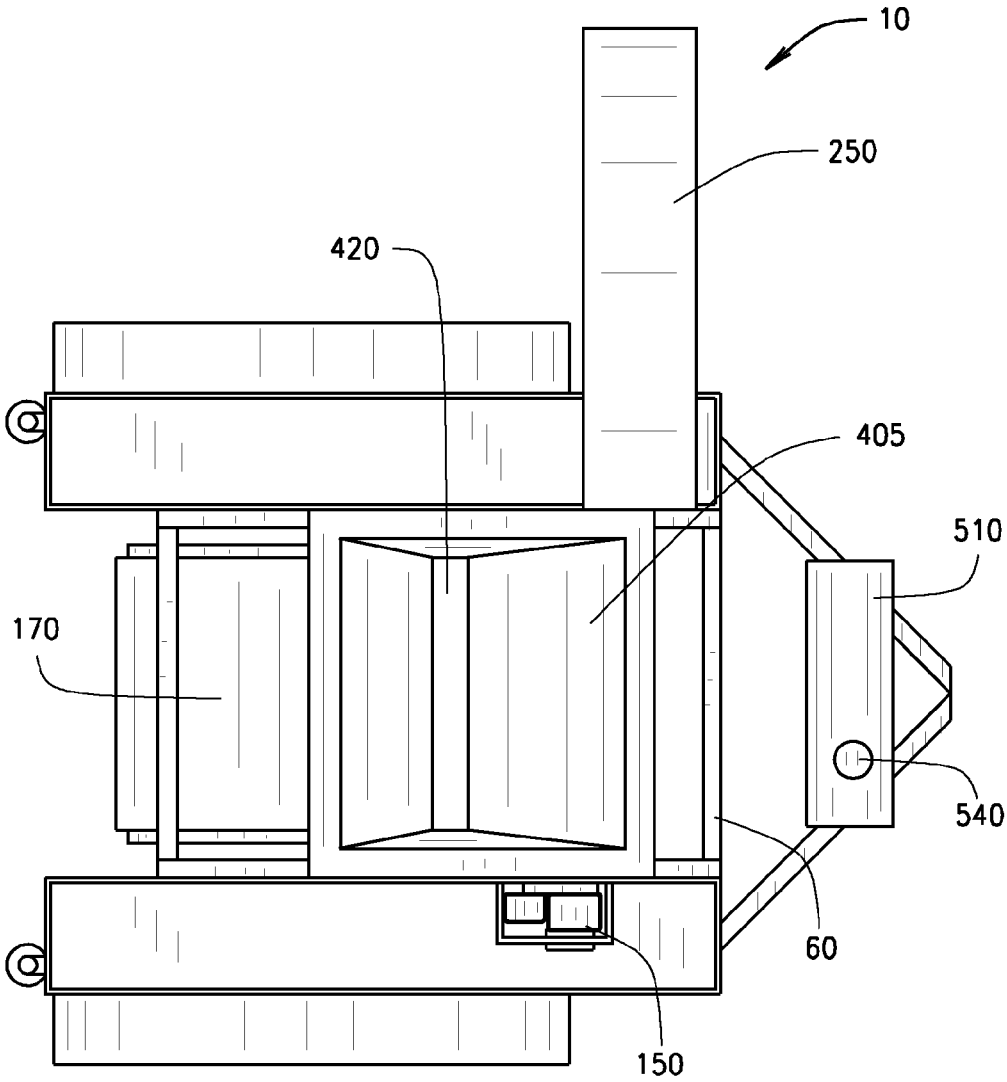
FIG. 6 is a top view of the apparatus for removing the fines from the mixture of rock and fines.

With reference to FIGS. 5 and 6, a lower portion of the hopper 405 includes a gate 420 and a movable door 430. The gate 420 provides an opening for the material 50 to exit from the hopper 405. The gate 420 opens to the interior holding portion 410 of the hopper 405. The door 430 is in a movable engagement with the hopper 405 to close and open the gate 420 to permit, stop and regulate the flow of the crushed rock material 50 from the hopper 405 onto the conveyor belt 102. One or more vibrators 450 may be positioned on or about the hopper 405 to vibrate the hopper 405 to assist in promoting the flow of the crushed rock material 50 from the hopper 405, through the gate 420, and onto the conveyor belt 102.

The hopper 405 is generally positioned above the conveyor belt 102. The gate 420 of the hopper 405 is positioned over the second end 107 of the conveyor belt 102 to drop or direct the crushed rock material 50 onto the second end 107 of the conveyor belt 102. The hopper 405 may hold approximately 1 yard to approximately 100 yards of crushed rock material 50, although the volume of the hopper 405 may be adjusted depending on the requirements of the apparatus 10. Moreover, the volume of the hopper 405 may be adjusted to suit the specific application or eliminated entirely. Other systems and means may be employed to provide the regulated flow of the crushed rock material 50 to the conveyor belt 102. The regulated flow of the crushed rock material 50 may come directly from the hopper 405, a surge pile fed by a vibrating feeder, a cold-feed bin, a belt feeder, belt scales, or directly linked to an existing plant.

With reference to FIGS. 2 and 3, a spray system 500 is shown. The spray system 500 includes a tank 510 in fluid communication with a nozzle 520 via a fluid line 530. A pump 540 pumps fluid from the tank 510 through the fluid line 530 and to the nozzle 520, which sprays the fluid on a bottom, upper surface of the belt 102. The nozzle 520 generally sprays most of or the entire width of the conveyor belt 102. The fluid may include water, a wetting agent, or other solution that causes the fines 54 to stick or adhere to the conveyor belt 102. The conveyor belt 102 should be sprayed with enough water to moisten the conveyor belt 102. The amount of fluid sprayed onto the conveyor belt 102 is preferably adjustable in order to accommodate a light or heavy dampening of the conveyor belt 102 depending on the nature, e.g., the moisture, gradation, type of the feed material, and the specification of the desired end product. If too much fluid is sprayed on the conveyor belt 102, then the discharging of the fines 54 may become sloppy and difficult to manage.

The fluid on the conveyor belt 102 provides for the extraction of the dust and fines from the crushed rock material 50. The crushed rock material 50 directed or dropped onto the conveyor belt 102 includes the fines 54 that generally stick or adhere to the conveyor belt 102 and are moved upward on the conveyor belt 102 toward the second end 107.

The coarse particles 58 of the crushed rock material 50 generally tumble or roll down the conveyor belt 102 toward the first end 106. The fines 54 ride on the conveyor belt 102 up and over the head pulley 153, where the scraper 200 scrapes the fines 54 from the conveyor belt 102.

The conveyor belt 102 is generally flat and linear in shape. In other embodiments, the conveyor belt 102 may have a troughed shape on its top surface 104 to better retain the flow of the crushed rock material 50. The conveyor belt 102 is generally continuous between the first end 106 and the second end 107. The conveyor belt 102 has a generally smooth surface, i.e., the conveyor belt 102 is free from protrusions or other structures on its top surface 104.

The conveyor belt 102 may have a width of approximately 1 foot to approximately 5 feet. The conveyor belt 102 may have a length of approximately 4 feet to approximately 30 feet. One of ordinary skill in the art will recognize that these dimensions may be varied (scaled up or down) to accommodate the quarry conditions, the loading and receiving equipment, the amount of the crushed rock material 50 requiring processing, and the processing rates required for the crushed rock material 50. The conveyor belt 102 may be made from a rubber or an elastomeric material. The conveyor belt 102 may be reinforced with other materials to improve durability. A vulcanized or seamless conveyor belt 102 will often provide more efficient results without wearing on the scraper 200.

Figure 7:
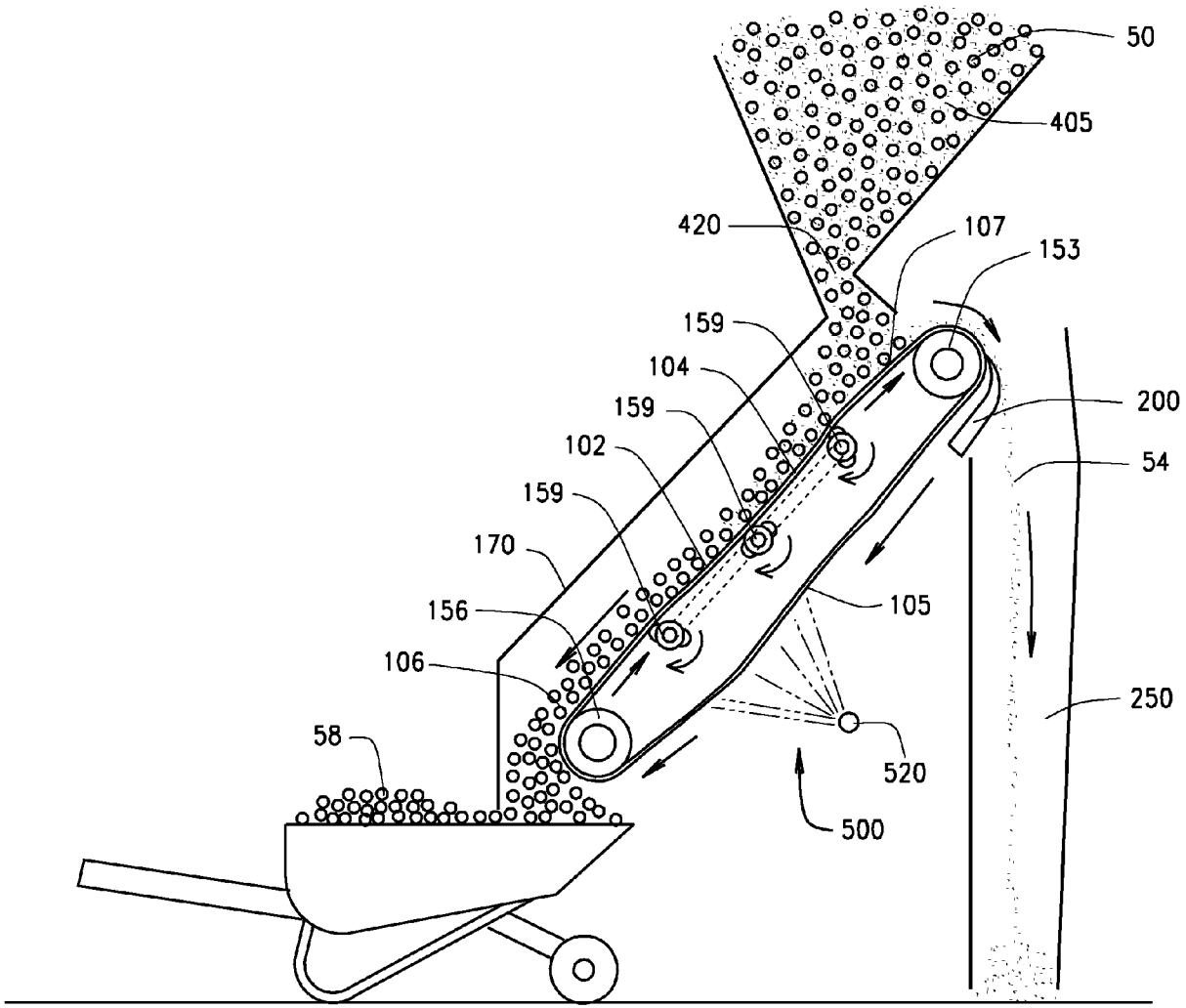
FIG. 7 is a schematic view of the belt system, the rock discharge and the fines discharge for removing the fines from the mixture of rock and fines.

With reference to FIGS. 3 and 7, the scraper 200 is in generally close contact with the conveyor belt 102 with little or no gap between the edge of the scraper 200 and the conveyor belt 102. Preferably, the scraper 200 is positioned on the bottom surface 105 of the belt 102 at or near the second end 107. By scraping the bottom surface 105, gravity assists in causing the scraped fines 54 to fall away from the conveyor belt 102. The scraper 200 physically scrapes the fines 54 from the bottom surface 105 of the conveyor belt 102. The scraper 200 directs the fines 54 into the discharge chute 250 that directs the fines 54 away from the apparatus 10. In the alternative, the scraper 200 may direct the fines onto a conveyor, vibrating feeder or other device that directs the fines 54 away from the apparatus 10. The discharge chute 250 may also be in communication with a further conveyor system or other transport system to move the fines 54 away from the apparatus 10.

The scraper 200 should have a width approximately the same width as the conveyor belt 102. The scraper 200 may be one continuous length or in staggered, overlapping shorter lengths that clean or scrape most of or all of the entire width of the conveyor belt 102.

The conveyor belt system 100 generally positions the conveyor belt 102 at an angle of approximately 25° to approximately 65° relative to the ground. This provides a sufficient angle such that the coarse particles 58 roll or fall down the conveyor belt 102 instead of being carried up and over the second end 107 of the conveyor belt 102. Certain embodiments include the conveyor belt 102 at an angle of approximately 40° to approximately 50° relative to the ground.

The conveyor belt 102 is moving in an opposite direction of the flow of the coarse particles 58. The motor 150, via the head pulley 153, moves the conveyor belt 102 at approximately 2 feet per second to approximately 20 feet per second. This rate of travel is sufficient to remove the fines 54 from the coarse particles 58 on the conveyor belt 102 of approximately 20 feet in length. One of ordinary skill in the art will be able to scale the apparatus 10 up to larger embodiments to process more crushed rock material 50 or vary the speed of the conveyor belt 102 to accommodate different materials. Preferably, the speed of the conveyor belt 102 is variable to accommodate different feed sizes, gradations, desired amount of fines removal, end-use specifications and output volume.

The belt adjusting system 190 and its belt angle adjuster 194 may be variably adjusted depending upon the crushed rock material 50 that is being processed by the apparatus 10. Generally, the angle of the belt 102 may need to be increased for finer crushed rock material 50 in order to reduce unwanted carryover of coarse particles 58. Further, the speed of the motor 150 may be increased or slowed down depending upon the nature of the crushed rock material 50. Generally, the speed of the motor 150 may need to be increased for finer crushed rock material 50 in order to reduce unwanted carryover of coarse particles 58.

The wetting of the belt 102 provides a wicking action to provide for the fines 54 to stick or adhere to the conveyor belt 102. The action of the coarse particles 58 tumbling, rolling or flowing down the conveyor belt 102 provides many opportunities to separate the fines 54 from the coarse particles 58 and its surfaces, as the coarse particles 58 contacts the belt 102 multiple times. Some of the fines 54 may be adhered to the coarse particles 58, and the wicking action of the wet conveyor belt 102 draws the fines 54 to stick to the wet conveyor belt 102.

The apparatus 10 and methods described herein provide for the separation of materials that are generally of the same type. For example, the fines 54 and coarse particles 58 are both made from limestone. The methods and the apparatus described herein are generally used on a dry crushed rock material 50. The methods and apparatus provide for loads of the crushed rock material 50 that may be out of specification for a particular construction application, by virtue of an excess fines content, to be processed and re-processed until the fines content is sufficiently reduced. For example, a load of the crushed rock material 50 with an excessive fines content may be repeatedly processed in the apparatus 10 until the fines content is sufficiently lowered.

The fines 54 removed from the coarse particles 58 may be used for many purposes, including, for example, as a fill material, a soil amendment, a mud-jacking medium, mineral filler in asphalt, or a landscaping material. Limestone dust may also act as a natural insecticide.

The following examples describe the use of the apparatus 10 and its ability to reduce the fines content of crushed rock. Table I shows the sieve sizes used to analyze the gradation of the crushed rock material.

TABLE I

| SIEVE SIZE | INCH OPENING |
|---|---|
| 3/8" | .3750 (3/8") |
| #4 | .187 (approx. 3/16") |
| #8 | .0937 (approx. 3/32") |
| #16 | .0469 (approx. 3/64") |
| #30 | .0232 |
| #50 | .0117 |
| #100 | .0059 |
| #200 | .0029 |

Table II shows the results of a gradation analysis performed on a ¼ inch clean dry screened crushed limestone material. Samples of the crushed limestone were analyzed before processing with the apparatus 10 using the sieves identified in Table I, and the results shown are in the "input material" column of Table II. After processing with the apparatus 10, the crushed limestone was again analyzed using the sieves identified in Table I with the results shown in the "output material" column of Table II. The output material is the "cleaned" finished product separated from the by-product material, i.e., the fines.

TABLE II

| ¼" CLEAN DRY SCREENED CRUSHED LIMESTONE | | |
|---|---|---|
| | PERCENT BY WEIGHT PASSING | |
| SIEVE OPENING | Input Material | Output Material |
| 3/8" | 100 | 100 |
| #4 | 81.1 | 80.5 |
| #8 | 25.0 | 13.2 |
| #16 | 10.6 | 6.1 |
| #30 | 9.1 | 5.2 |
| #50 | 8.5 | 4.8 |
| #100 | 8.1 | 4.6 |
| #200 | 7.3 | 4.3 |

As shown in Table II, the −200 content of the crushed limestone has been reduced from 7.3% by weight in the input material to 4.3% by weight of the output material. The crushed limestone could optionally be processed again with the apparatus 10 to further lower the −200 content.

Further tests were conducted on a 3/8 inch clean dry screened crushed limestone material and the results are shown in Table III. The results shown in Table II and III illustrate how the apparatus 10 may be used to remove additional fines from crushed rock that has already been dry screened. Often, dry screened rock falls "out-of-specification" because the dry screening process does not sufficiently remove the fines.

TABLE III

| 3/8" CLEAN DRY SCREENED CRUSHED LIMESTONE | | |
|---|---|---|
| | PERCENT BY WEIGHT PASSING | |
| SIEVE OPENING | Input Material | Output Material |
| 3/8" | 100 | 100 |
| #4 | 14.5 | 13.3 |
| #8 | 5.1 | 3.3 |
| #16 | 4.5 | 2.8 |
| #30 | 4.3 | 2.7 |
| #50 | 4.1 | 2.7 |
| #100 | 4.0 | 2.7 |
| #200 | 3.6 | 2.4 |

As shown in Table III, the −200 content of the crushed limestone has been reduced from 3.6% by weight of the input material to 2.4% by weight of the output material. The crushed limestone could optionally be processed again with the apparatus 10 to further lower the −200 content.

Table IV illustrates the use of the apparatus 10 on a material made of the end-product fines removed by conventional dry screening processes, generally a ⅛ inch minus dry screened crushed limestone. The end-product fines, after being processed to a consistent gradation, are saleable for manufactured sand. As shown in Table IV, the −200 content of the crushed limestone has been reduced from 31.6% by weight of the input material to 8.7% by weight of the output material, thus improving the consistency of the gradation of the material.

TABLE IV

| ⅛" MINUS DRY SCREENED CRUSHED LIMESTONE | | |
|---|---|---|
| | PERCENT BY WEIGHT PASSING | |
| SIEVE OPENING | Input Material | Output Material |
| 3/8" | 100 | 100 |
| #4 | 100 | 100 |
| #8 | 96.6 | 93.3 |
| #16 | 72.3 | 53.6 |
| #30 | 57.1 | 27.7 |
| #50 | 38.9 | 14.0 |
| #100 | 38.9 | 11.0 |
| #200 | 31.6 | 8.7 |

For the processing described in Tables II, III, and IV, the conveyor belt 102 was set at 42 degrees elevation and the conveyor belt 102 was moving at a speed of 372 feet per minute. The conveyor belt 102 used was 24 inches wide (19 inches between edges of the flashing material) and 6½ feet long. As described above, the width and length of the conveyor belt 102 may be sized up for full-scale processing.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A method of separating fines from a mixture of rock and fines, comprising:

activating a motorized conveyor belt system comprising a conveyor belt moving in an upward direction;

activating a spray system to spray a fluid onto an underneath surface of the conveyor belt;

directing the mixture of rock and fines to an upper third region of a length of the conveyor belt;

moving the conveyor belt in an upward direction between a first end and a second end, wherein the first end is lower than the second end;

collecting the rock at the first end of the conveyor belt; and scraping the fines off of the conveyor belt at the second end of the conveyor belt.

2. The method according to claim 1, wherein the fines and the rock are both of the same material.

3. The method according to claim 1, further comprising adjusting the speed of the conveyor belt or adjusting the angle of the conveyor belt.

4. The method according to claim 1, further comprising directing the mixture of rock and fines onto the conveyor belt near the second end.

5. The method according to claim 1, wherein the mixture of rock and fines directed to the conveyor belt are generally dry.

6. The method according to claim 1, further comprising directing the rock down a majority of the conveyor belt.

7. A method of reducing a fines content of a mixture of coarse particles and fines, comprising:

providing the mixture of the coarse particles and the fines into a material feed system, wherein the mixture is essentially dry, the material feed system comprising a hopper that is positioned over a conveyor belt;

spraying the conveyor belt with a fluid;

moving the conveyor belt in an upward direction;

dropping the mixture onto an elevated portion of the conveyor belt; and providing the coarse particles to roll or tumble down the conveyor belt in an opposite direction that the conveyor belt is moving; and scraping the fines from an underneath surface of the conveyor belt.

8. The method according to claim 7, further comprising discharging the coarse particles at a coarse particle discharge and discharging the fines at a fines discharge, wherein the coarse particle discharge is at a lower end of the conveyor belt, and the fines discharge is at a higher end of the conveyor belt.

9. The method according to claim 7, wherein the coarse particles are moving in an opposite direction of the fines.

10. The method according to claim 7, wherein the fines stick or adhere to the conveyor belt and move with the conveyor belt in the upward direction.

11. The method according to claim 7, further comprising reducing carry over of the coarse particles by adjusting a speed of the belt.

12. An apparatus to separate fines from rock, comprising:

a conveyor belt system, comprising a moving belt, a motor to move the belt, the belt including a first end and a second end, wherein the second end is elevated relative to the first end;

a spray system, comprising a source of fluid, a sprayer in fluidic communication with the source of the fluid, and the sprayer positioned to spray a surface of the belt with the fluid;

a material feed system, comprising a hopper to discharge a material comprising fines and rock onto the belt, and the belt moving from the first end to the second end in an upward direction, wherein the material feed system discharges the material anywhere in an upper third region of a length the belt; and a fines discharge to receive fines from the belt; and, a rock discharge at the first end of the belt.

13. The apparatus according to claim 12, wherein the conveyor belt is approximately 25 degrees to approximately 65 degrees relative to the ground.

14. The apparatus according to claim 12, wherein the conveyor belt moves at approximately 2 feet per second to approximately 20 feet per second.

15. The apparatus according to claim 12, wherein the belt system vibrates the conveyor belt.

16. The apparatus according to claim 12, wherein the conveyor belt is generally linear and continuous between the first end and the second end.

17. The apparatus according to claim 12, further comprising a scraper positioned on a bottom surface of the conveyor belt to scrape fines from the conveyor belt.

18. The apparatus according to claim 12, wherein the fines are a −200 material.

19. The apparatus according to claim 12, wherein the hopper is positioned above the conveyor belt to drop the material onto the conveyor belt near the second end of the conveyor belt.

20. The apparatus according to claim 12, wherein the conveyor belt system comprises a plurality of cage idlers to vibrate the moving belt.

21. The apparatus according to claim 20, wherein the cage idlers are positioned between a head pulley at the second end of the conveyor belt and a tail pulley at the first end of the belt.

22. The apparatus according to claim 12, wherein the moving belt is generally smooth.

23. The apparatus according to claim 12, wherein the scraper is positioned on an underneath surface of the moving belt to scrape fines from the moving belt, and the fines discharge collects fines from the scraper, and the sprayer sprays an underneath surface of the belt.

24. The apparatus according to claim 12, wherein the material feed system discharges the material near the elevated second end of the belt.

25. A method of separating fines from a mixture of rock and fines, comprising:

providing a mixture of rock and fines, wherein the rock and fines are a same rock material;

activating a motorized conveyor belt system comprising a conveyor belt moving in an upward direction;

activating a spray system to spray a fluid onto an underneath surface of the conveyor belt;

directing the mixture of rock and fines to the conveyor belt;

moving the conveyor belt in an upward direction between a first end and a second end, wherein the first end is lower than the second end;

collecting the rock at the first end of the conveyor belt; and scraping the fines off of the conveyor belt at the second end of the conveyor belt.

* * * * *